US008220902B2

(12) United States Patent
Petruchik et al.

(10) Patent No.: US 8,220,902 B2
(45) **Date of Patent: *Jul. 17, 2012**

(54) PRINTHEAD WITH IMPROVED INK TANK MOUNTING RELIABILITY

(75) Inventors: Dwight J. Petruchik, Honeoye Falls, NY (US); James J. Haflinger, San Diego, CA (US); Arthur K. Wilson, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 352 days.

This patent is subject to a terminal disclaimer.

(21) Appl. No.: 12/620,614

(22) Filed: Nov. 18, 2009

(65) Prior Publication Data

US 2011/0115858 A1 May 19, 2011

(51) Int. Cl.
*B41J 2/14* (2006.01)

(52) U.S. Cl. ..... 347/49

(58) Field of Classification Search ..... 347/43, 347/49, 50, 86

See application file for complete search history.

(56) References Cited

U.S. PATENT DOCUMENTS

| | | | | |
|---|---|---|---|---|
| 6,203,147 | B1 * | 3/2001 | Battey et al. | 347/86 |
| 6,302,535 | B1 * | 10/2001 | Sturgeon et al. | 347/86 |
| 6,322,205 | B1 | 11/2001 | Childers et al. | |
| 6,796,646 | B2 * | 9/2004 | Komplin et al. | 347/86 |
| 6,955,422 | B2 * | 10/2005 | Miyazawa et al. | 347/86 |
| 7,008,053 | B2 * | 3/2006 | Hashii et al. | 347/86 |
| 2008/0151032 | A1 | 6/2008 | Trafton et al. | |
| 2011/0115860 | A1 * | 5/2011 | Petruchik et al. | 347/87 |

* cited by examiner

*Primary Examiner* — Anh T. N. Vo
(74) *Attorney, Agent, or Firm* — Peyton C. Watkins

(57) ABSTRACT

An inkjet printhead that receives one or more detachably mountable ink tanks, the inkjet printhead includes an ink tank holding receptacle that receives the one or more detachably mountable ink tanks between a first and second wall; a spring disposed on the first wall of the printhead to provide a biasing force in a direction that pushes the detachably mountable ink tank away from the first wall of the printhead and which biasing force must be manually overcome in order to properly install the one or more detachably mountable ink tanks in the ink tank holding receptacle of the printhead.

23 Claims, 13 Drawing Sheets

PRINTHEAD WITH IMPROVED INK TANK MOUNTING RELIABILITY

CROSS-REFERENCE TO RELATED APPLICATION

Reference is made to commonly assigned, copending U.S. patent application Ser. No. 12/620,611, filed Nov. 18, 2009 by Dwight J. Petruchik, et al., entitled "Carriage with Improved Print Cartridge Mounting Reliability", and commonly assigned U.S. patent application Ser. No. 12/620,619, filed Nov. 18, 2009 by Dwight J. Petruchik, et al, entitled "Ink Tank Feature for Improved Mounting Reliability".

FIELD OF THE INVENTION

The present invention relates generally to a printhead for an inkjet printer, and more particularly to the mounting of a detachably mountable ink tank to the printhead.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink tank is depleted. Carriage mounted ink tanks typically contain only enough ink for up to about several hundred prints. This is because the total mass of the carriage needs be limited so that accelerations of the carriage at each end of the travel do not result in large forces that can shake the printer back and forth. As a result, users of carriage printers need to replace carriage-mounted ink tanks periodically depending on their printing usage, typically several times per year. Consequently, the task of replacing a detachably mounted ink tank must be simple and must consistently achieve a proper engagement of the ink tank with the printhead. Otherwise, improper mounting of the ink tank may lead to leaks, may cause poorly formed images due to an improper communication of ink from the ink tank to the printhead, and may result in user frustration.

US Patent Application Publication 2008/0151032, incorporated herein by reference, discloses an ink tank having a data storage device mounted on a pedestal such that the pedestal can extend through an opening in a supporting structure of the printhead. As such, when the printhead is mounted on the carriage, and the ink tank is installed in the printhead, the data storage device on the ink tank pedestal makes contact with an electrical contact on the carriage. As a result, the printer can detect that an ink tank has been installed. However, on some occasions, it is found that the user accidentally does not fully press the ink tank into its latched position onto the printhead, but the data storage device still touches the electrical contact on the carriage. Thus, the printer falsely detects a properly installed ink tank when, in fact, the ink tank is improperly installed.

What is needed is a user-friendly mounting configuration that eliminates false indications of ink tank installations while enabling reliable detection of properly mounted ink tanks.

SUMMARY OF THE INVENTION

The present invention is directed to overcoming one or more of the problems set forth above. Briefly summarized, according to one aspect of the invention, the invention resides in an inkjet printhead that receives one or more detachably mountable ink tanks, the inkjet printhead includes an ink tank holding receptacle that receives the one or more detachably mountable ink tanks between a first and second wall; a spring disposed on the first wall of the printhead to provide a biasing force in a direction that pushes the detachably mountable ink tank away from the first wall of the printhead and which biasing force must be manually overcome in order to properly install the one or more detachably mountable ink tanks in the ink tank holding receptacle of the printhead.

DETAILED DESCRIPTION OF THE INVENTION

Figure 1:
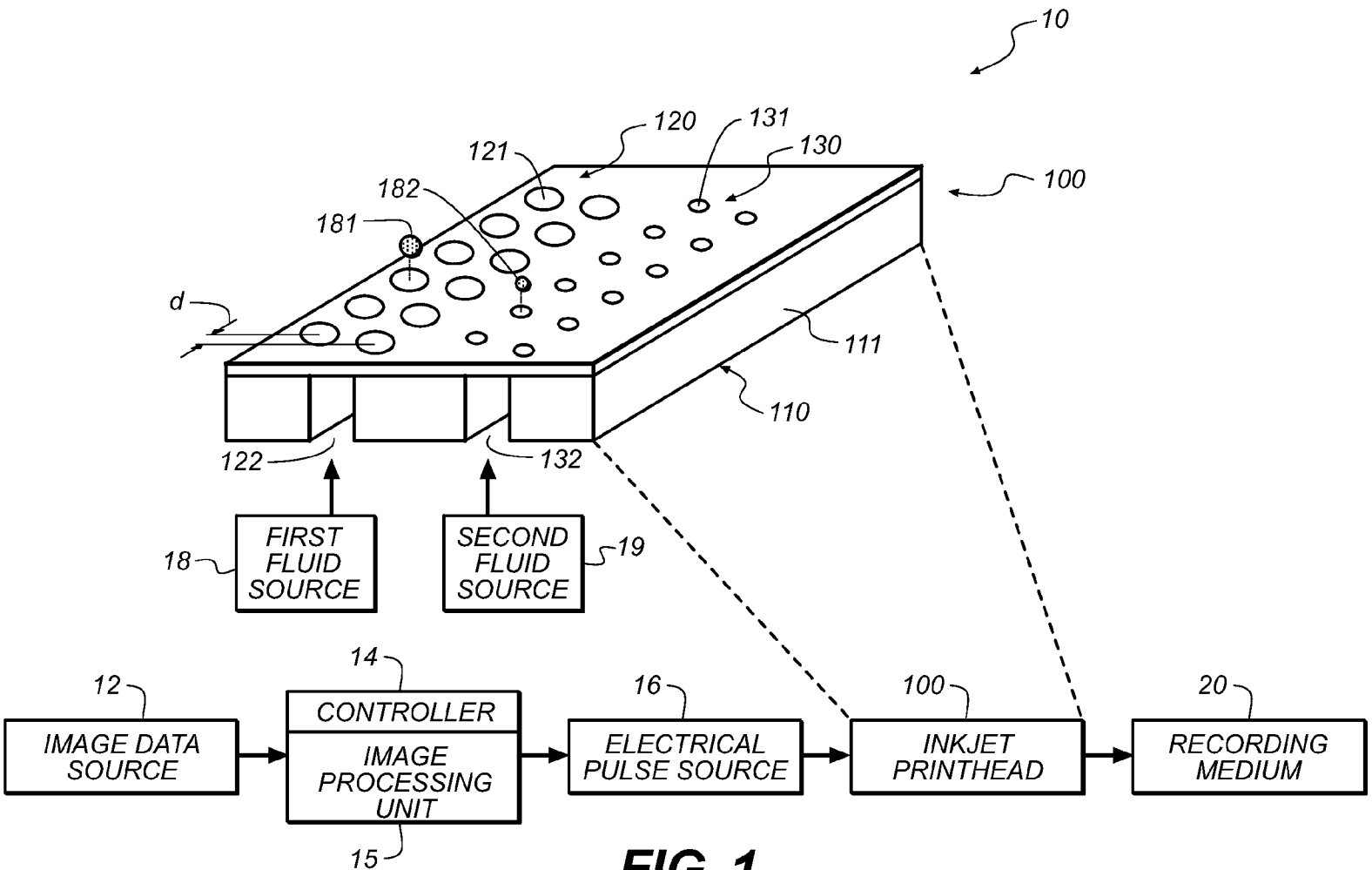
FIG. 1 is a schematic representation of an inkjet printer system of the present invention.

Referring to FIG. 1, a schematic representation of an inkjet printer system 10 is shown for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and the controller 14 outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, and the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
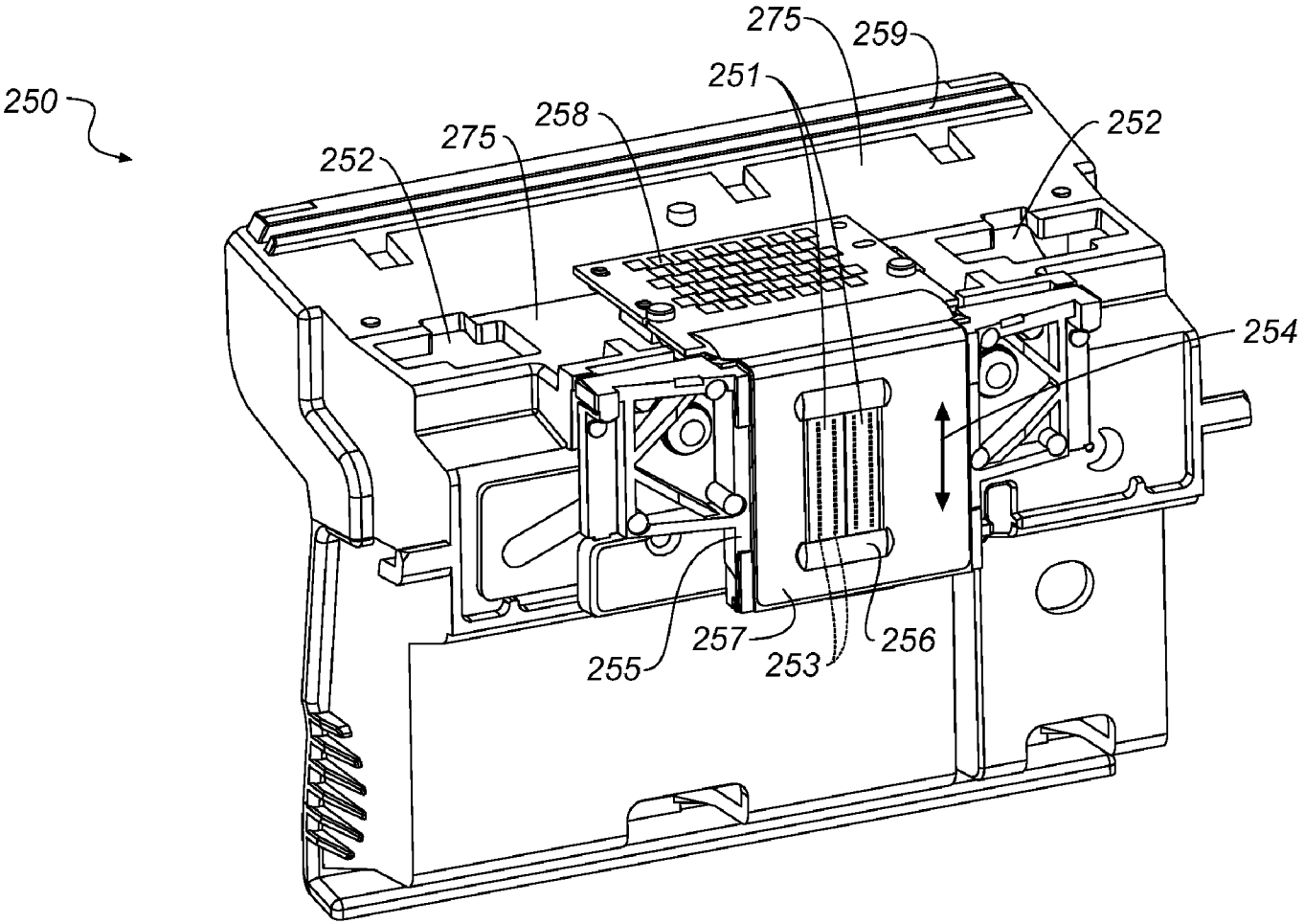
FIG. 2 is a perspective view of a portion of a printhead of the present invention.

FIG. 2 shows a perspective view of a portion of a printhead 250, which is an example of an inkjet printhead 100. Printhead 250 includes two printhead die 251 (similar to printhead die 110 in FIG. 1) that are affixed to mounting substrate 255. Each printhead die 251 contains two nozzle arrays 253 so that printhead 250 contains four nozzle arrays 253 altogether. The four nozzle arrays 253 in this example can each be connected to separate ink sources (not shown in FIG. 2); such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them.

Flex circuit 257 bends around the side of printhead 250 and connects to connector board 258. A lip 259 on rear wall 275 serves as a catch for latching print cartridge 250 into carriage 200 at latch 249 (see FIG. 13). When printhead 250 is mounted into the carriage 200 (see FIG. 3), connector board 258 is electrically connected to a printhead electrical connector on the carriage 200 so that electrical signals can be transmitted to the printhead die 251. Printhead 250 also includes two openings 252 in a rear wall 275. When ink tanks are mounted onto printhead 250, devices mounted on pedestals on the ink tanks can extend through openings 252, as described below.

Figure 3:
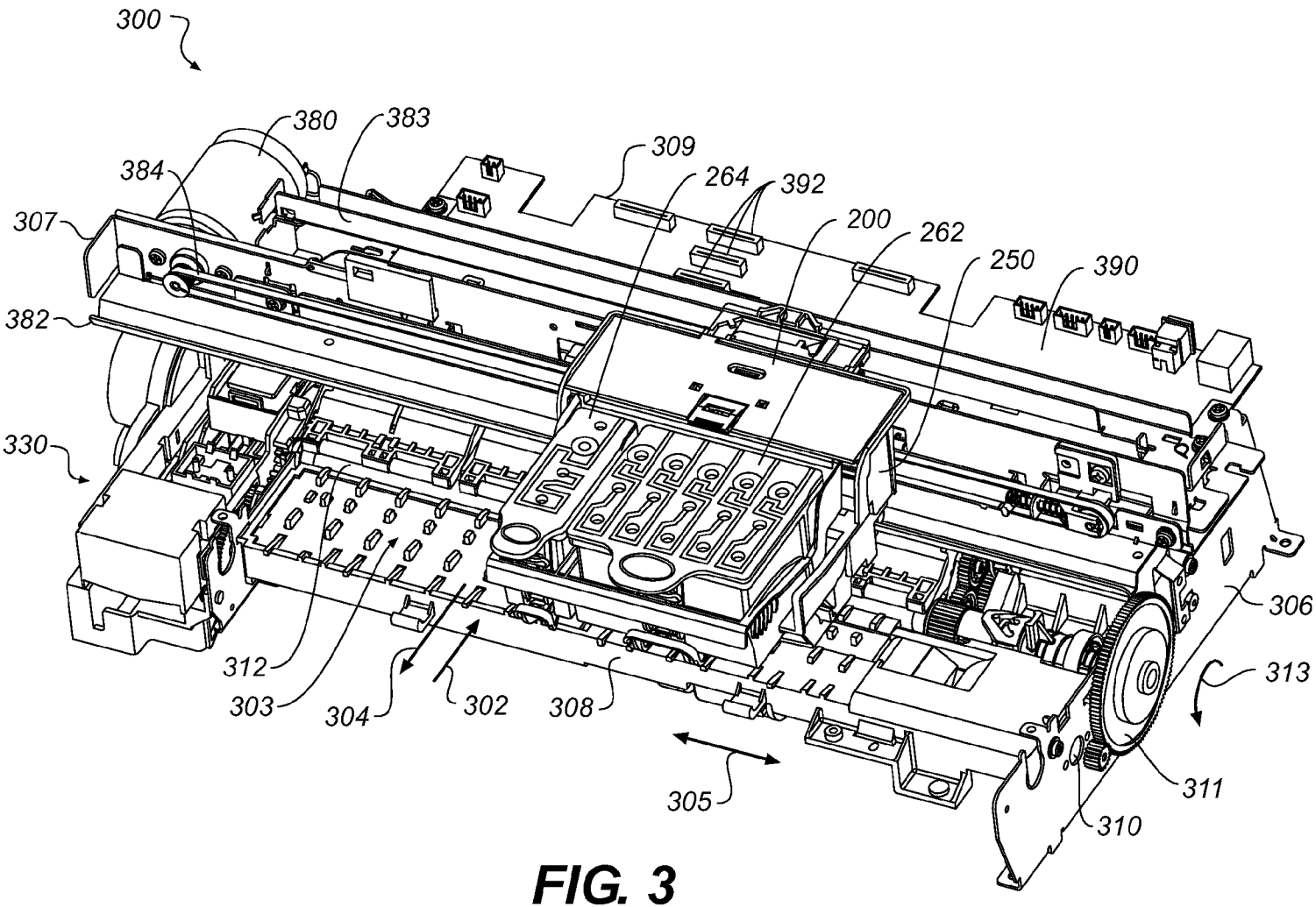
FIG. 3 is a perspective view of a portion of a carriage printer of the present invention.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are mounted onto the printhead 250. A printhead together with one or more detachably mountable ink tanks mounted onto it is sometimes called a printhead assembly. The mounting orientation of printhead 250 is rotated relative to the view in FIG. 2 so that the printhead die 251 are located at the bottom side of printhead 250, the droplets of ink being ejected downward onto the recording medium in print region 303 in the view of FIG. 3. Multi-chamber ink tank 262, in this example, contains three ink sources: cyan, magenta, and yellow; while single-chamber ink tank 264 contains the ink source for black. Paper or other recording medium (sometimes generically referred to as paper or media herein) is loaded along paper load entry direction 302 toward the front of printer chassis 308.

Figure 4:
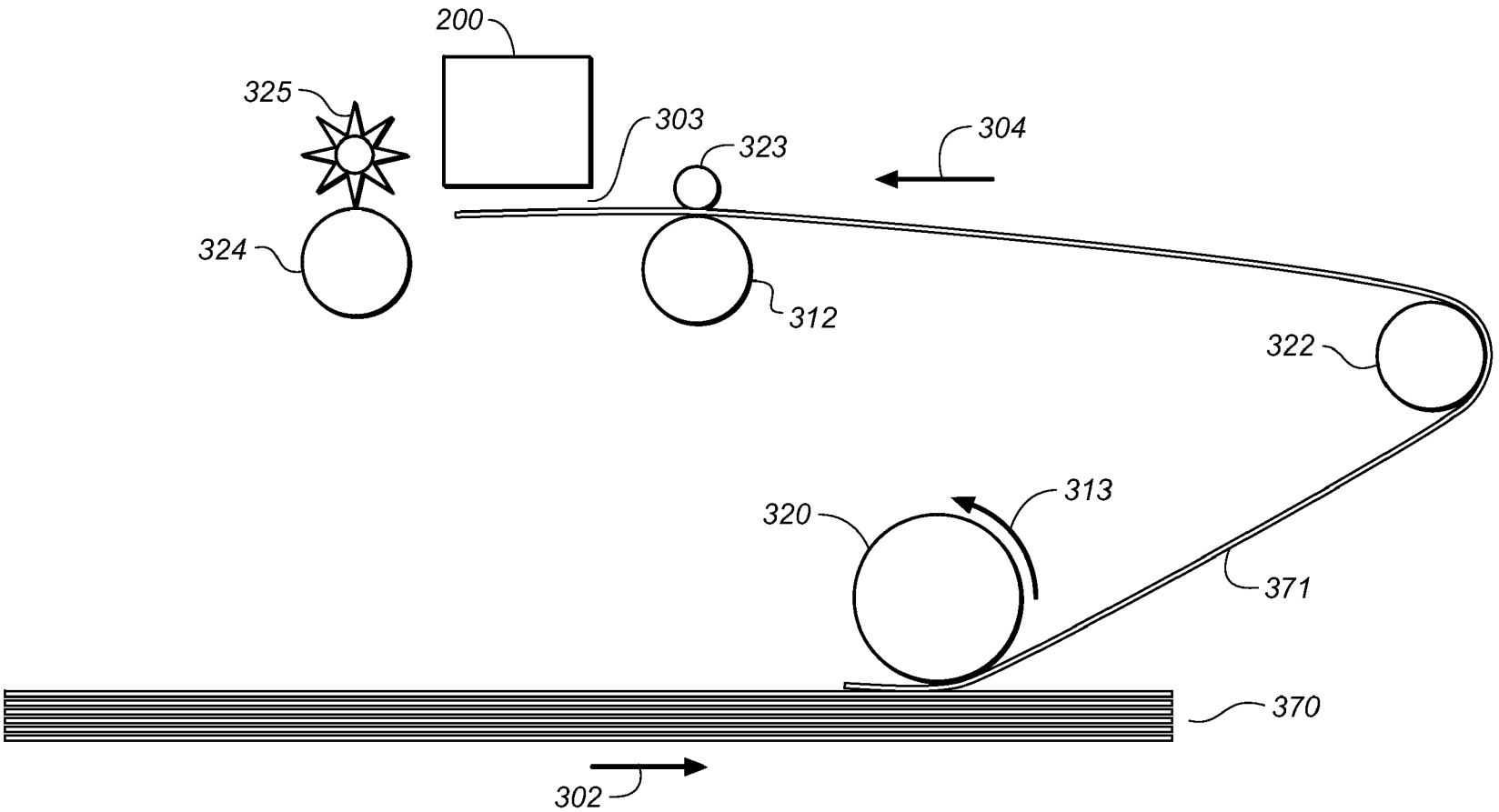
FIG. 4 is a schematic side view of an exemplary paper path in a carriage printer of FIG. 3.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the printer chassis right-side 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the printer chassis left-side 307, in the example of FIG. 3, is the maintenance station 330.

Toward the printer chassis rear 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
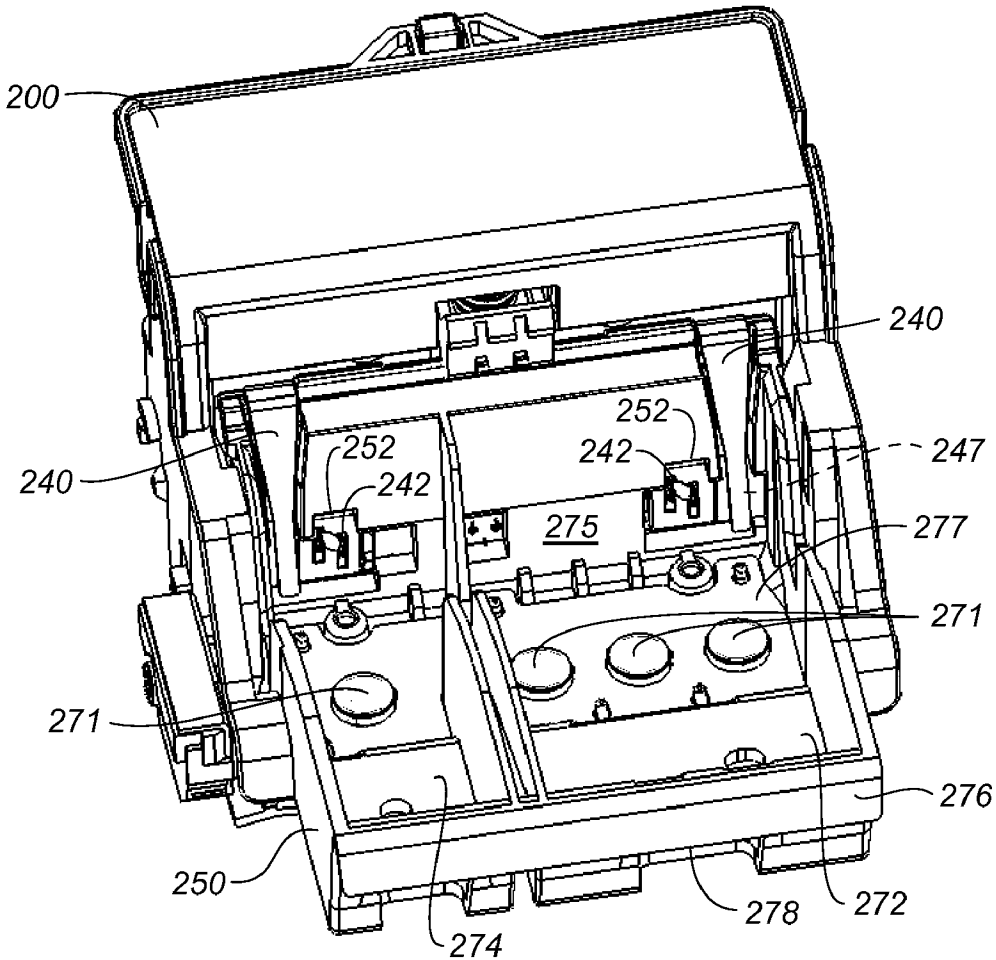
FIG. 5 is a perspective view of a printhead mounted in a carriage, according to an embodiment of the invention.

FIG. 5 shows a printhead 250, according to an embodiment of this invention, mounted in carriage 200. No ink tanks are mounted onto printhead 250 in FIG. 5 so that the holding receptacle(s) 272 and 274 for ink tanks can be more clearly seen. Printhead 250 is partitioned into a holding receptacle 272 for multi-chamber ink tank 262 having three chambers, and holding receptacle 274 for a single-chamber ink tank 272 having one chamber (see also FIGS. 3 and 6). As such, there are three ink inlet ports 271 in holding receptacle 272, and one ink inlet port 271 in holding receptacle 274. In the orientation shown in FIG. 5, printhead 250 includes a substantially vertical rear wall 275, a front wall 276 opposite rear wall 275, and a substantially horizontal bottom wall 277 extending between rear wall 275 and front wall 276. In other words, bottom wall 277 is disposed at an angle with respect to rear wall 275. An opening 278 in front wall 276 serves as a catch for an ink tank latch, as described below. In the example of FIG. 5, ink inlets 271 are disposed on bottom wall 277. Visible through openings 252 in rear wall 275 of printhead 250 are electrical connectors 242 that are mounted on carriage 200. As described in more detail below, electrical connectors 242 are provided for making electrical connection with one or more electrical contacts on the detachably mounted ink tanks to be mounted in holding receptacles 272 and 274 of printhead 250. Electrical connectors 242 can be connected by cables to controller 14 at printer electronics board 390 as described above relative to FIG. 3.

Also shown in FIG. 5 are two springs 240 disposed on rear wall 275 of printhead 250 (one in each holding receptacle 272 and 274). In this embodiment, springs 240 are leaf springs that extend downward toward ends that are near openings 252. As described in more detail below, each spring 240 provides a biasing force in a direction that pushes the respective detachably mountable ink tank away from rear wall 275 of printhead 250. This biasing force must be manually overcome in order to complete the installation of the respective detachably mountable ink tank into the corresponding ink tank holding receptacle.

Figure 6:
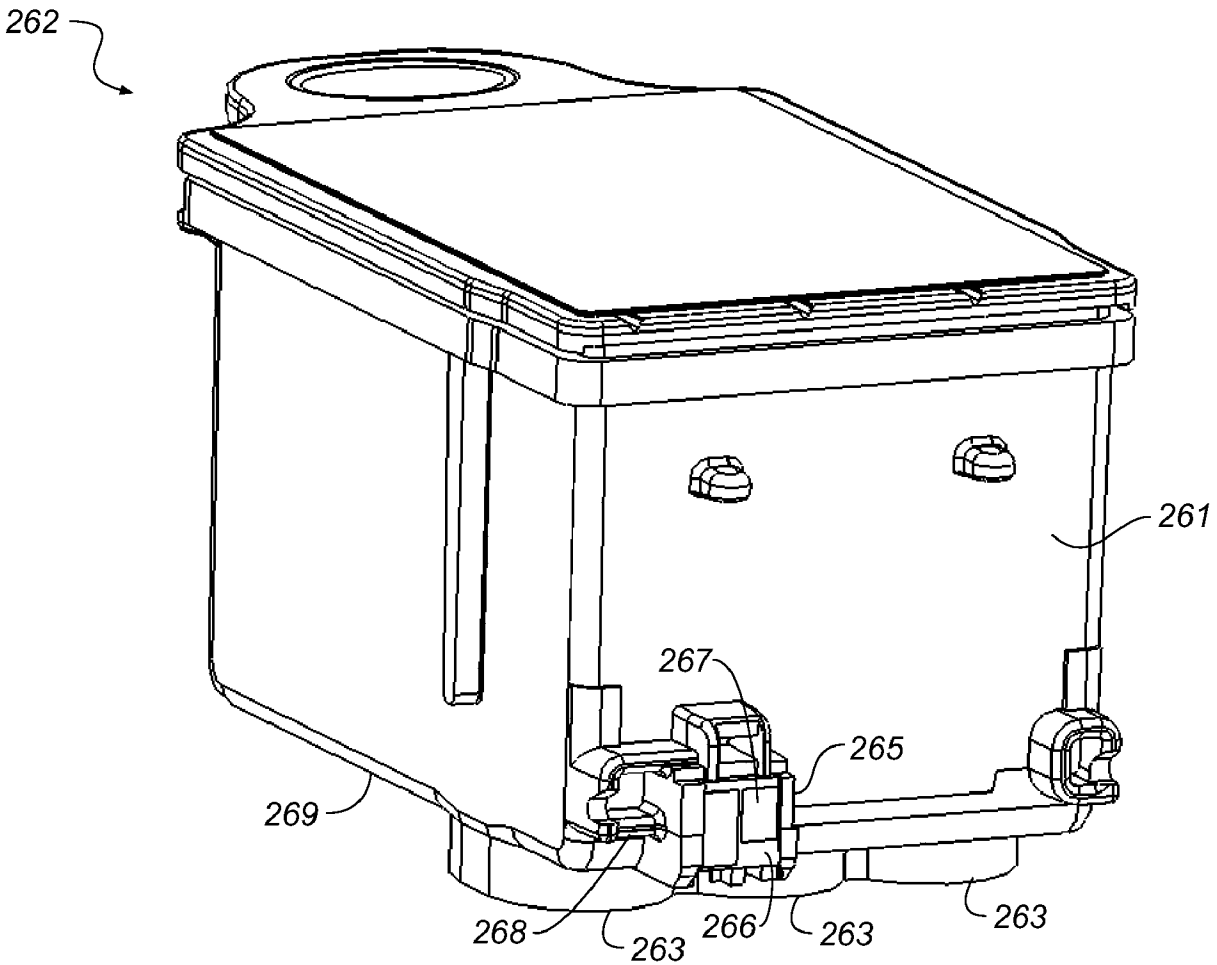
FIG. 6 is a perspective rear view of an ink tank for mounting in the printhead of FIG. 5.

FIG. 6 shows an unmounted multi-chamber ink tank 262 for mounting in the printhead 250 shown in FIG. 5. Although this embodiment is described in terms of multi-chamber ink tank 262, single chamber ink tank 264 is similarly installed in the printhead 250. Multi-chamber ink tank 262 includes three ink outlet ports 263 disposed on a bottom face 269. Extending from rear face 261 of multi-chamber ink tank 262 is a pedestal 265 of the type described in US Patent Application Publication 2008/0151032. Affixed to pedestal 265 is a device 266 having one or more electrical contacts 267. In some embodiments device 266 can be a data storage device (i.e. a memory device) or circuit for storing and providing information relative to the ink tank. In other embodiments device 266 can be a different type of electronic device or even just one or more passive electrical contacts 267 in order to complete a tank detection circuit when they make electrical connection with electrical connector 242. When multi-chamber ink tank 262 is fully installed in printhead 250 (FIG. 5), electrical contacts 267 make electrical connection with electrical connector 242. Controller 14, which is electrically connected to electrical connector 242, can detect whether electrical connector 242 has made contact with electrical contacts 267. Engagement feature 268 extends from rear face 261 for engaging spring 240. Spring 240 tends to push the ink tank and its corresponding electrical contacts 267 away from electrical connector 242 unless the ink tank is fully installed and latched into position. In that way, controller 14 does not falsely detect an improperly installed ink tank. An improperly installed ink tank will have its electrical contacts 267 pushed away from electrical connector 242. Only a properly installed ink tank will have its electrical contacts 267 in connected to electrical connector 242 and be detected by controller 14.

Figure 7:
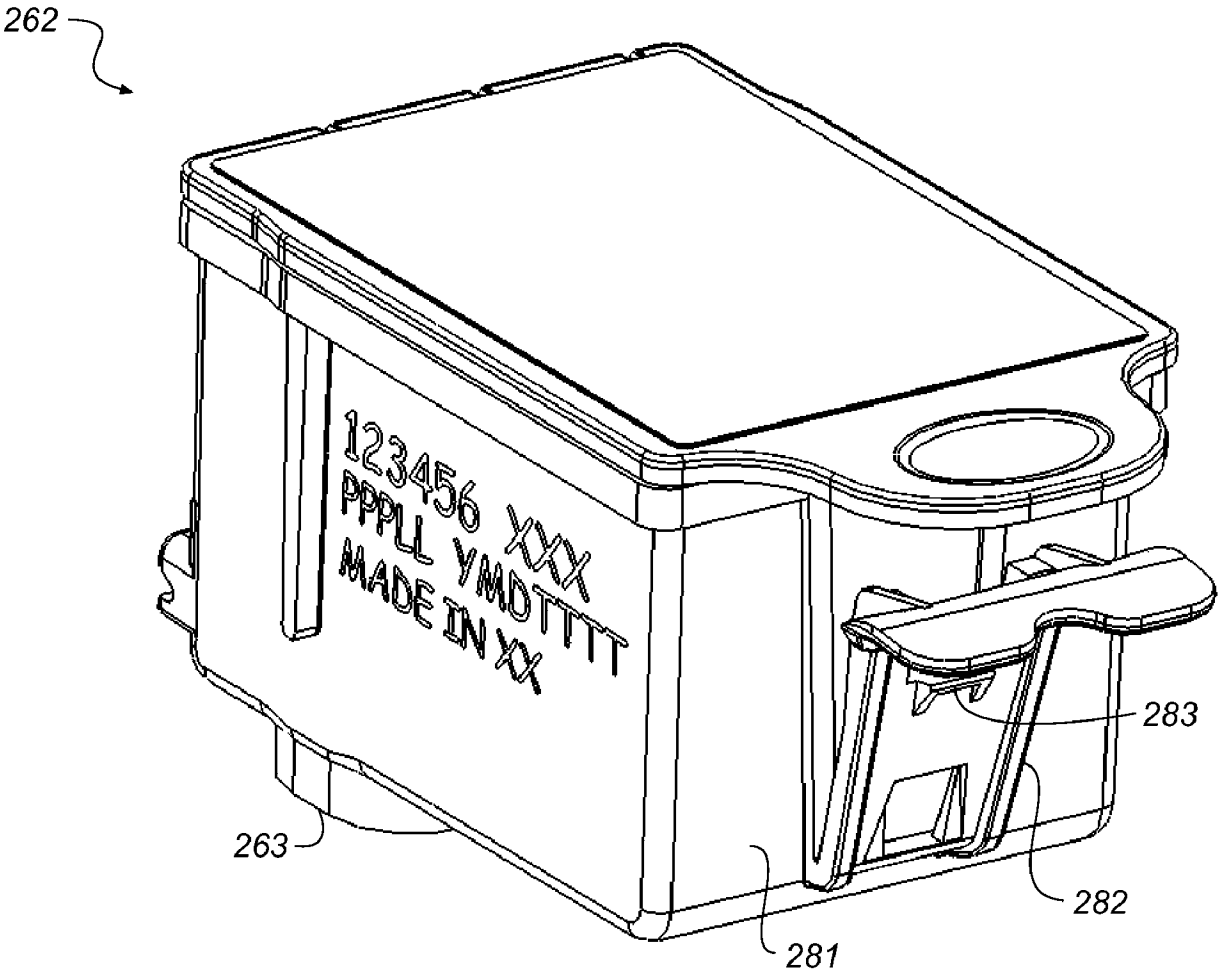
FIG. 7 is a perspective front view of the ink tank of FIG. 6.

FIG. 7 shows a view of multi-chamber ink tank 262 that is rotated relative to FIG. 6. Extending from front face 281 of multi-chamber ink tank 262 is a lever 282 that includes a latch 283. When multi-chamber ink tank 262 is properly installed in holding receptacle 272 of printhead 250 (see FIG. 5), latch 283 engages with an opening 278 serving as a catch in front wall 276, as described in more detail below.

Figure 8:
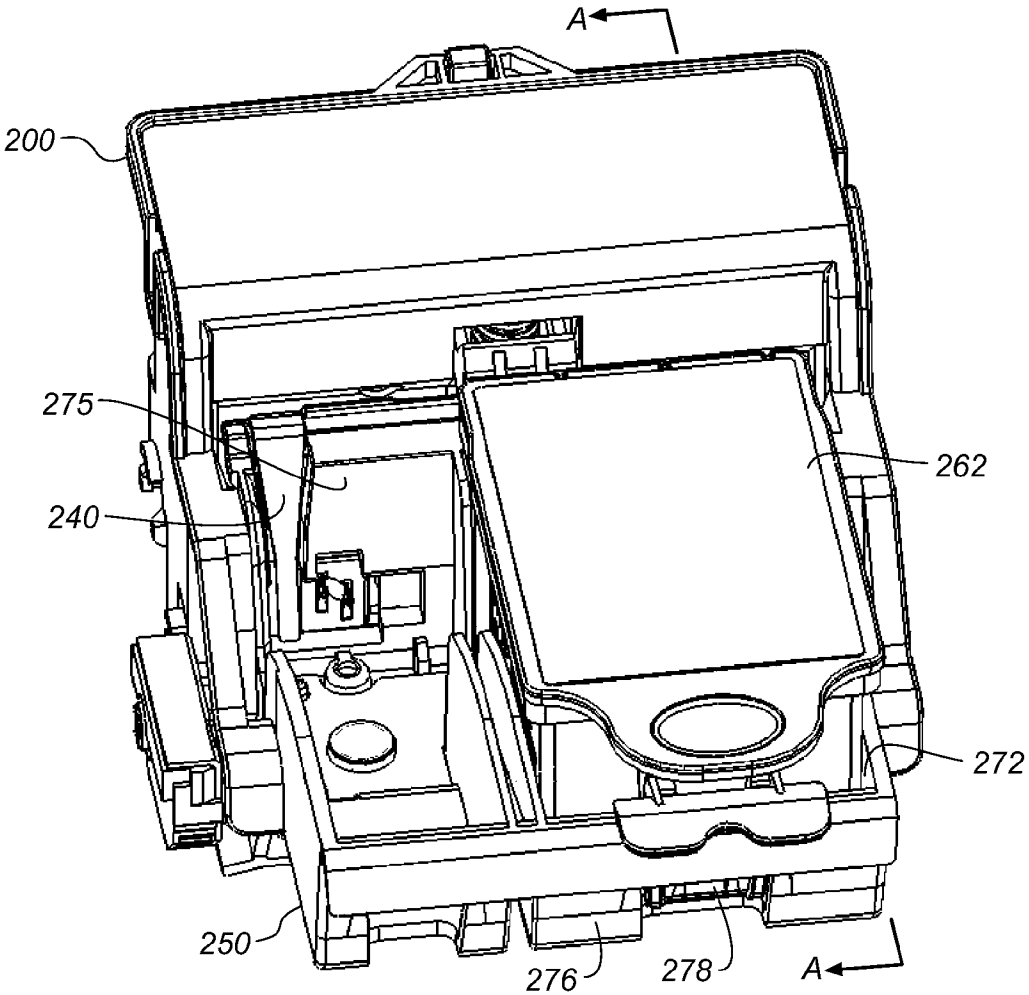
FIG. 8 is a perspective view of the ink tank of FIG. 6 of the present invention properly installed onto the printhead and carriage of FIG. 5.
Figure 9:
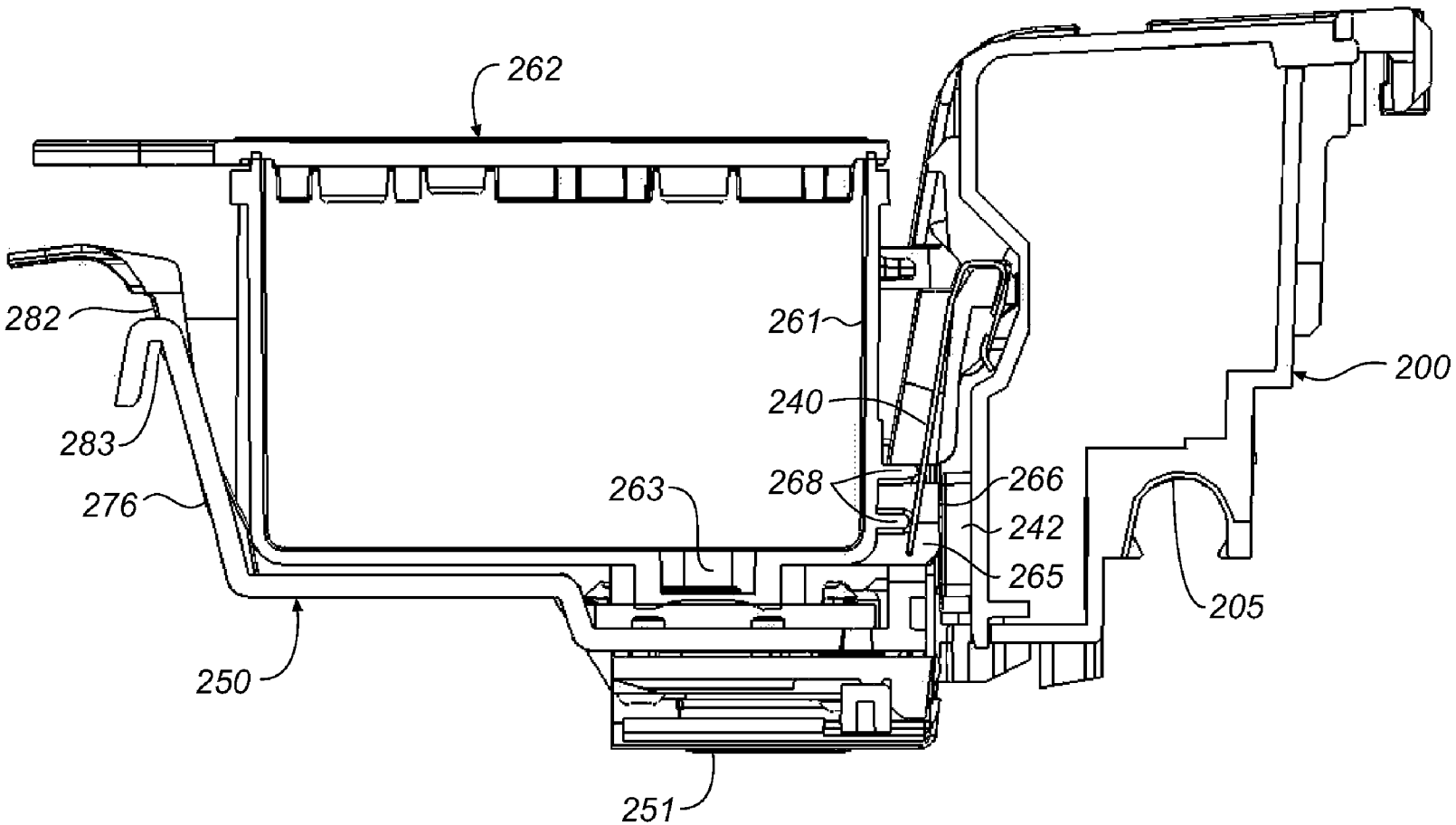
FIG. 9 is a cross-sectional side view along A-A of FIG. 8.
Figure 10:
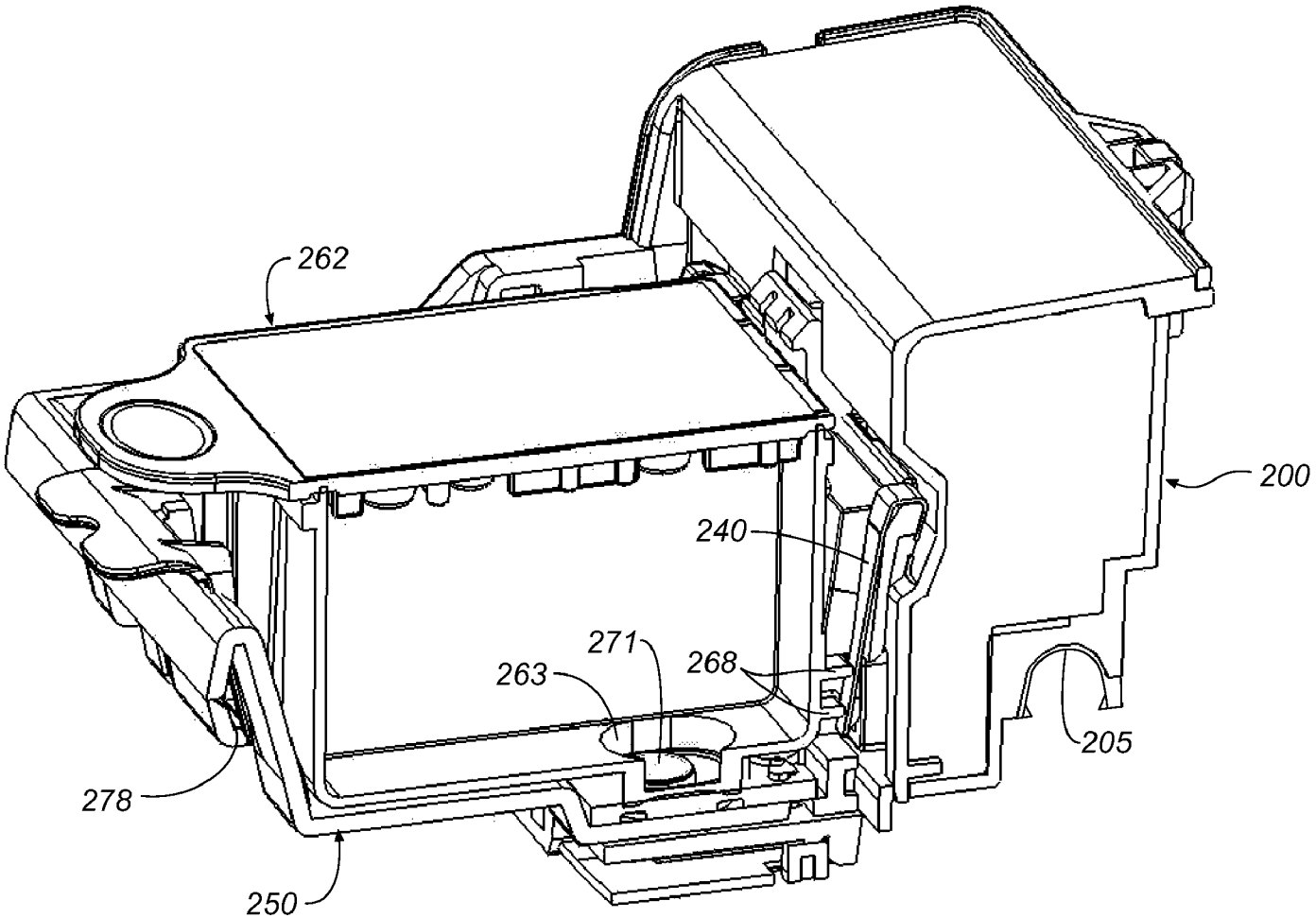
FIG. 10 is a cross-sectional perspective view along A-A of FIG. 8.

FIG. 8 shows a perspective view; FIG. 9 shows a cross-sectional side view along A-A of FIG. 8; and FIG. 10 shows a cross-sectional perspective view of multi-chamber ink tank 262 properly mounted onto printhead 250, which is installed onto carriage 200. In this embodiment, leaf spring 240 on printhead 250 angles downward, such that the upper portion of spring 240 is farther away from rear face 261 of installed ink tank 262 and the lower portion of spring 240 is closer to rear face 261. Engagement feature 268 includes two projections (i.e. raised features from rear face 261). The upper projection extends a greater distance from the rear face 261 than the lower projection does, in order to accommodate the angle of leaf spring 240. Pedestal 265 is shown to be pushed up against electrical connector 242. This pushes the electrical contacts of device 266 into contact with electrical connector 242. Latch 283 extends through an opening in front wall 276 of printhead 250 so that the ink tank is properly mounted. As seen in FIGS. 9 and 10, ink from multi-chamber ink tank 262 can exit through ink outlet port 263, enter ink inlet port 271 of printhead 250, and travel along ink passageways to printhead die 251. Also shown in FIG. 9 is carriage bushing 205 where carriage 200 makes contact with the carriage guide rail 382 of FIG. 3.

Multi-chamber ink tank 262 is installed between rear wall 275 and front wall 276 in ink tank holding receptacle 272 of printhead 250, as shown in FIG. 8. Note that ink tank 262 is taller than front wall 276 so that it is not meant that the entire ink tank 262 is within boundaries defined by rear wall 275 and front wall 276. In other embodiments, a portion of ink tank 262 can extend laterally beyond front wall 276. By saying that multi-chamber ink tank 262 is installed between rear wall 275 and front wall 276, it is meant that at least a portion of ink tank 262 is between rear wall 275 and front wall 276. Furthermore, in some embodiments, front wall 276 can be a bar, rather than a full wall, that extends between the sidewalls of printhead 250. A primary function of front wall 276 is to provide opening 278 to serve as the catch for latch 283 to engage with.

Figure 11:
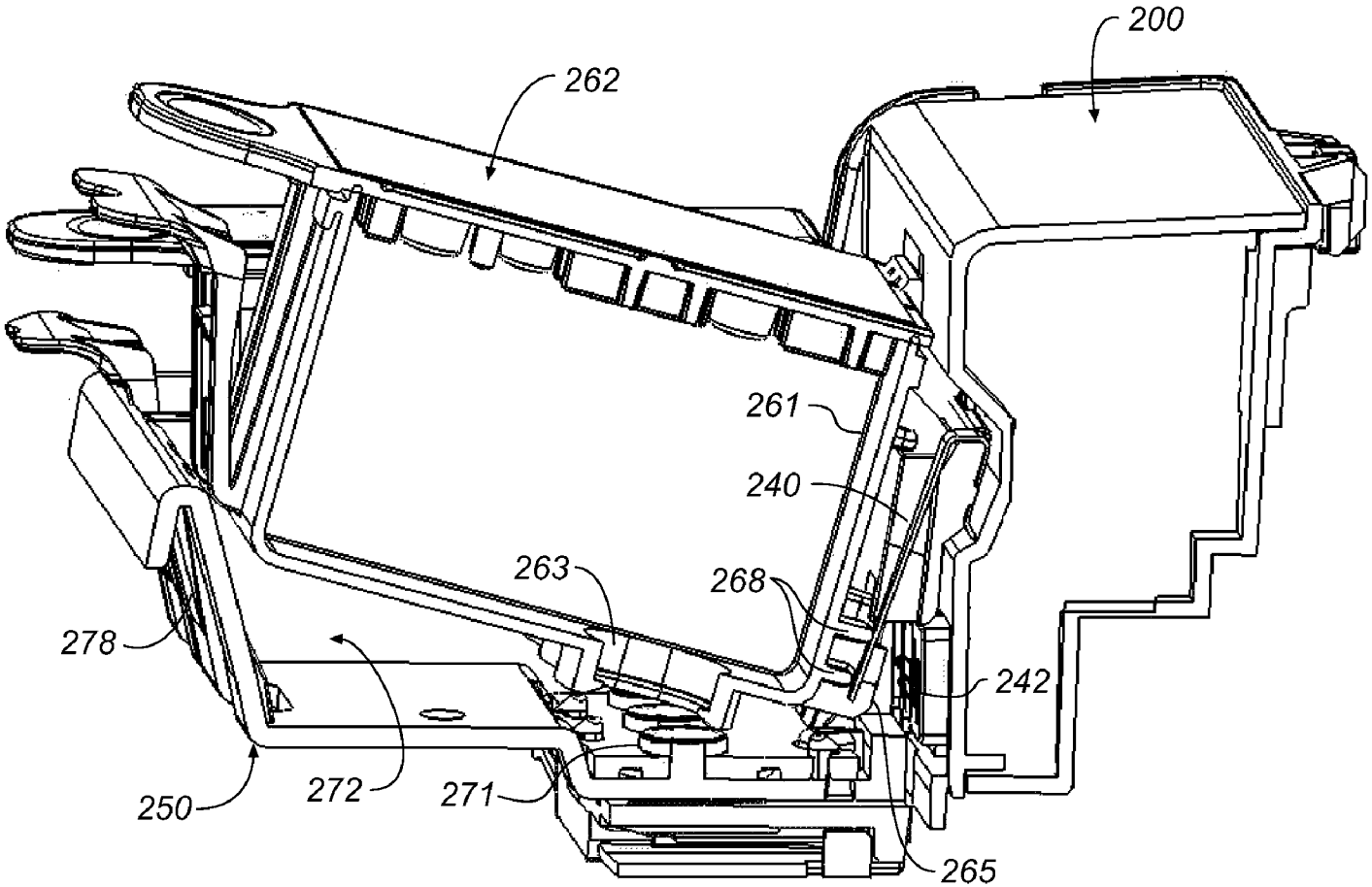
FIG. 11 is a cross-sectional perspective view similar to FIG. 10, but for an incompletely installed ink tank.
Figure 12:
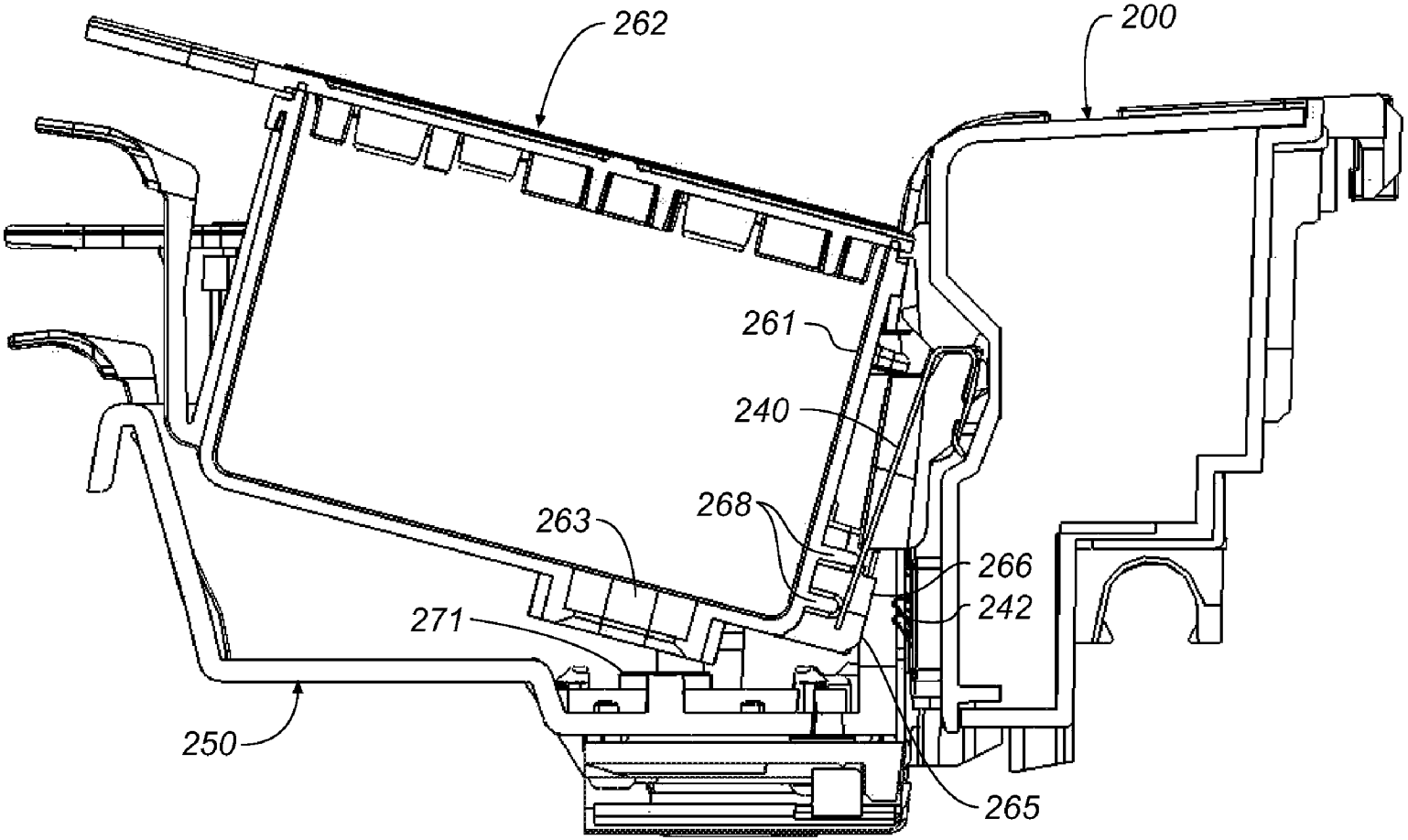
FIG. 12 is a cross-sectional side view corresponding to FIG. 11.

Shown in FIGS. 11 and 12 are perspective cross-sectional and side cross-sectional views of a multi-chamber ink tank 262 that is not completely installed into holding receptacle 272 of printhead 250. With reference also to FIG. 5, a side wall of printhead 250 and an inner wall that forms a partition between holding receptacles 272 and 274 help to guide multi-chamber ink tank 262 such that it approaches rear wall 275 at a downward angle, as described in more detail in US Patent Application Publication 2008/0151010, incorporated herein by reference. In this way (with reference also to FIG. 5) it is possible to guide pedestal 265 (together with device 266 and electrical contacts 267) into opening 252, and then guide ink outlet port 263 more vertically downward over ink inlet port 271 of printhead 250 during ink tank installation. As can be seen in FIGS. 11 and 12, an incompletely installed ink tank 262 is restrained from further movement by leaf spring 240 and engagement feature 268, such that electrical contacts of device 266 are held away from electrical connector 242. In other words, ink tank 262 is prevented by spring 240 from reaching a position such as shown in FIG. 9, where the electrical contacts of device 266 are able to make connection with electrical connector 242. Thus, the printer controller will not falsely detect that the ink tank 262 has been properly installed. The printer will not continue with further operations until the user manually pushes ink tank 262 down further so that it is latched by latch 283 and thereby properly installed with electrical contacts of device 266 making connection with electrical connector 242.

As it may be appreciated, angled leaf spring 240 is particularly appropriate for use where the ink tank 262 (with reference to FIG. 6) has electrical contacts substantially parallel to one direction (e.g. rear face 261), and ink outlet ports 263 substantially parallel to a different direction (e.g. bottom face 269). Leaf spring 240 provides a pivoting force that tends not only to push electrical contacts 267 out and away from electrical connector 242, but also tends to push ink outlet ports 263 up and away from ink inlet ports 271. Thus ink outlet ports 263 (which can, for example, include a fibrous wick at the outlet opening) do not scuff across ink inlet ports 271 (which can, for example, include a filter mesh at the inlet opening).

In another embodiment spring 240 is part of a micro-switch. Rather than tank detection relying upon electrical connection between electrical contacts on a pedestal as described above, in this embodiment detection of an installed tank occurs when the spring is sufficiently displaced by the tank that the micro-switch closes and completes a circuit. FIG. 5 shows the location of an optional switch contact 247 (behind the lower end of leaf spring 240 to serve as a type of micro-switch.

Figure 13:
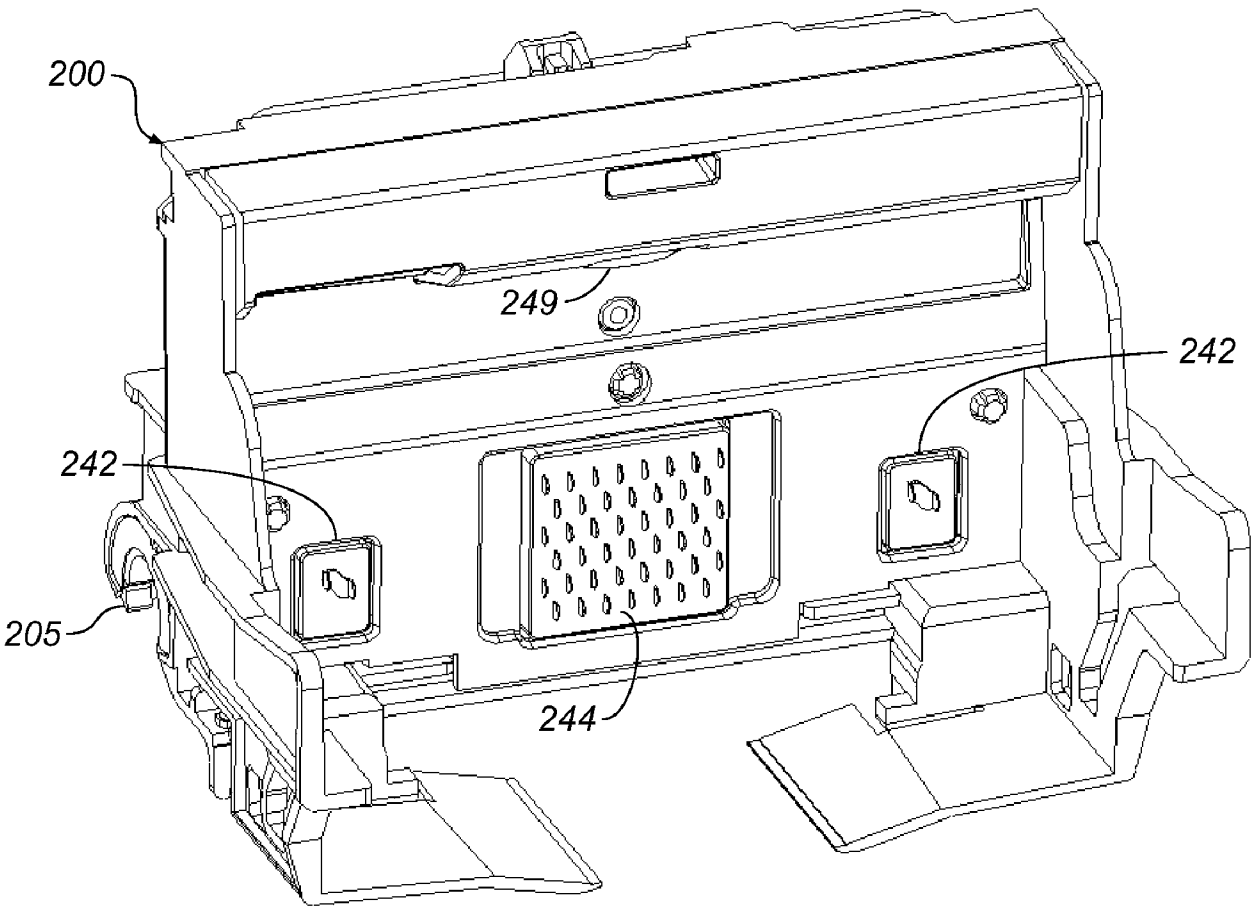
FIG. 13 is a perspective view of a carriage of the present invention.

FIG. 13 shows a perspective view of a carriage 200. Printhead connector 244 of carriage 200 mates with connector board 258 when the printhead 250 is installed in the carriage 200. Electrical contacts 267 (see FIG. 6) mate with electrical connectors 242 in carriage 200 when the ink tank is properly installed in the installed printhead 250.

In other embodiments, electrical contacts and ink contacts can extend from a single face of ink tank 262 (e.g. rear face 261 or bottom face 269). In such embodiments, it is contemplated that spring 240 can be a compression spring rather than a leaf spring. Engagement feature 268 on ink tank 262 would be configured to engage with a compression spring, rather than with an angled leaf spring.

U.S. Pat. No. 6,322,205 describes interconnect portions including a fluid inlet, an air outlet and electrical interconnect that are all parallel to the same direction (see column 6 lines 43-56 and FIGS. 3 and 8). Coil springs bias a floating platform including the interconnect portions toward the installed ink container. In contrast, the present invention is different in that spring 240 biases the interconnect portions (i.e. electrical connector 242 and ink inlet ports 271) away from their counterparts (i.e. electrical contacts 267 and ink outlet ports 263) on ink tank 262.

In summary, the present invention resides in an inkjet printhead that receives one or more detachably mountable ink tanks, the inkjet printhead includes an ink tank holding receptacle that receives the one or more detachably mountable ink tanks between a first and second wall; and a spring disposed on the first wall of the printhead to provide a biasing force in a direction that pushes the detachably mountable ink tank away from the first wall of the printhead and which biasing force must be manually overcome in order to properly install the one or more detachably mountable ink tanks in the ink tank holding receptacle of the printhead.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
205 Carriage bushing
240 Spring
242 Electrical connector

244 Printhead electrical connector
247 Optional switch contact
249 Latch
250 Printhead
251 Printhead die
252 Opening
253 Nozzle array
254 Nozzle array direction
255 Mounting substrate
256 Encapsulant
257 Flex circuit
258 Connector board
259 Lip
261 Rear face
262 Multi-chamber ink tank
263 Ink outlet port
264 Single-chamber ink tank
265 Pedestal
266 Device
267 Electrical contact
268 Engagement feature
269 Bottom face
271 Ink inlet port
272 Holding receptacle (for multi-chamber ink tank)
274 Holding receptacle (for single-chamber ink tank)
275 Rear wall
276 Front wall
277 Bottom wall
278 Opening (catch)
281 Front face
282 Lever
283 Latch
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors

The invention claimed is:

1. An inkjet printhead that receives one or more detachably mountable ink tanks, the inkjet printhead comprising:

an ink tank holding receptacle that receives the one or more detachably mountable ink tanks between a first and second wall; and a spring disposed on the first wall of the printhead to provide a biasing force in a direction that pushes the detachably mountable ink tank away from the first wall of the printhead and which biasing force must be manually overcome in order to properly install the one or more detachably mountable ink tanks in the ink tank holding receptacle of the printhead; wherein the first wall includes a hole through the first wall to receive the electrical contact of the detachably mountable ink tank when the detachably mountable ink tank is installed on the inkjet printhead.

2. The inkjet printhead of claim 1 further comprising a third wall disposed at an angle with respect to the first wall, wherein an ink inlet port is disposed on the third wall.

3. The inkjet printhead of claim 2, wherein the spring is a leaf spring.

4. The inkjet printhead of claim 2, wherein the biasing force further comprises a pivoting force to push the ink outlet port of the detachably mountable ink tank away from the ink inlet port.

5. An inkjet printhead assembly comprising:

a) one or more detachably mountable ink tanks, the ink tank comprising:
(i) an ink outlet port; and
(ii) an electrical contact; and b) an inkjet printhead comprising:
(i) an ink tank holding receptacle including a wall, wherein the ink tank holding receptacle is configured to receive the one or more detachably mountable ink tanks and the wall includes a hole through the wall to receive the electrical contact of the detachably mountable ink tank when the detachably mountable ink tank is installed on the inkjet printhead;
(ii) a spring disposed on the wall of the printhead to provide a biasing force in a direction that pushes the detachably mountable ink tank away from the wall of the printhead and which biasing force must be manually overcome in order to properly install the one or more detachably mountable ink tanks in the ink tank holding receptacle of the printhead; and
(iii) a latch to hold an installed detachably mountable ink tank in the printhead when the latch is engaged.

6. The inkjet printhead assembly of claim 5, wherein, when the latch is engaged, the detachably mountable ink tank is located at a first position, and wherein, when the latch is not engaged, the spring prevents the detachably mountable ink tank from reaching the first position.

7. The inkjet printhead assembly of claim 5, wherein the spring is a leaf spring.

8. The inkjet printhead assembly of claim 5, wherein the biasing force further comprises a pivoting force to push the ink outlet port of the detachably mountable ink tank away from the ink inlet port.

9. The inkjet printhead assembly of claim 5, wherein one or more detachably mountable ink tanks include an engagement feature that pushes against the spring when the detachably mountable ink tank is installed on the inkjet printhead.

10. The inkjet printhead assembly of claim 5, wherein the one or more detachably mountable ink tanks further comprise a memory device that is connected to the electrical contact.

11. An inkjet printer comprising:

(a) an inkjet printhead that receives one or more detachably mountable ink tanks, the inkjet printhead comprising:
(i) an ink tank holding receptacle that receives the one or more mountable ink tanks between a first and second wall; and
(ii) a spring disposed on the first wall of the printhead to provide a biasing force in a direction that pushes the detachably mountable ink tank away from the first wall of the printhead and which biasing force must be manually overcome in order to properly install the one or more detachably mountable ink tanks in the ink tank holding receptacle of the printhead; wherein the first wall includes a hole through the first wall to receive the electrical contact of the detachably mountable ink tank when the detachably mountable ink tank is installed on the inkjet printhead;

(b) an electrical connector for making electrical connection with an electrical contact of the detachably mountable ink tank; and (c) a controller electrically connected to the electrical connector.

12. The inkjet printer of claim 11 further comprising a third wall disposed at an angle with respect to the first wall, wherein an ink inlet port is disposed on the third wall.

13. The inkjet printer of claim 12, wherein the spring is a leaf spring.

14. The inkjet printer as in claim 13 further comprising a latch to hold an installed detachably mountable ink tank in the printhead when the latch is engaged.

15. The inkjet printer of claim 14, wherein, when the latch is engaged, the detachably mountable ink tank is located at a first position, and wherein, when the latch is not engaged, the spring prevents the detachably mountable ink tank from reaching the first position.

16. The inkjet printer of claim 14 further comprising an electrical connector for making electrical connection with the electrical contact disposed on the second face of the detachably mountable ink tank when the detachably mountable ink tank is installed on the printhead and the latch is engaged.

17. The inkjet printer of claim 12, wherein the biasing force further comprises a pivoting force to push the ink outlet port of the detachably mountable ink tank away from the ink inlet port.

18. An inkjet printer comprising:

an inkjet printhead assembly comprising:

a) one or more detachably mountable ink tanks, the ink tank comprising:

(i) an ink outlet port; and (ii) an electrical contact; and b) an inkjet printhead comprising:

(i) an ink tank holding receptacle that receives the one or more detachably mountable ink tanks between a first and second wall; and (ii) a spring disposed on the first wall of the printhead to provide a biasing force in a direction that pushes the detachably mountable ink tank away from the first wall of the printhead and which biasing force must be manually overcome in order to properly install the one or more mountable ink tanks in the ink tank holding receptacle of the printhead; wherein the first wall includes a hole through the first wall to receive the electrical contact of the detachably mountable ink tank when the detachably mountable ink tank is installed on the inkjet printhead.

19. The inkjet printhead assembly of claim 18, wherein the spring is a leaf spring.

20. The inkjet printer of claim 18, wherein the biasing force further comprises a pivoting force to push the ink outlet port of the detachably mountable ink tank away from the ink inlet port.

21. The inkjet printer of claim 18, wherein one or more detachably mountable ink tanks include an engagement feature that pushes against the spring when the detachably mountable ink tank is installed on the inkjet printhead.

22. The inkjet printer of claim 18, wherein the one or more detachably mountable ink tanks further comprise a memory device that is connected to the electrical contact.

23. The inkjet printer of claim 18 further comprising a microswitch including an open position and a closed position, wherein when the detachably mountable ink tank is properly installed in the inkjet holding receptacle, the microswitch is in its closed position, and wherein when the detachably mountable ink tank is not properly installed in the inkjet holding receptacle, the microswitch is in its open position.

* * * * *